United States Patent [19]

Numata

[11] 4,240,008

[45] Dec. 16, 1980

[54] AUTOMATIC ELECTRONIC FLASH LIGHT DEVICE

[75] Inventor: Saburo Numata, Urawa, Japan

[73] Assignee: Fuji Photo Optical Co., Ltd., Omiya, Japan

[21] Appl. No.: 10,690

[22] Filed: Feb. 9, 1979

[51] Int. Cl.[3] ..... H05B 41/32

[52] U.S. Cl. ..... 315/151; 315/241 P

[58] Field of Search ..... 315/151, 159, 241 P; 354/33, 128, 137, 145

[56] References Cited

U.S. PATENT DOCUMENTS 3,783,336 1/1974 Vital et al. ..... 315/159

FOREIGN PATENT DOCUMENTS 2019721 10/1971 Fed. Rep. of Germany ..... 315/241 P

*Primary Examiner*—Eugene R. LaRoche

[57] ABSTRACT

In an automatic electronic flash light device, an integrating circuit which integrates the amount of light reflected from an object to be photographed is started by a signal delayed from a trigger signal of a flash tube.

3 Claims, 1 Drawing Figure

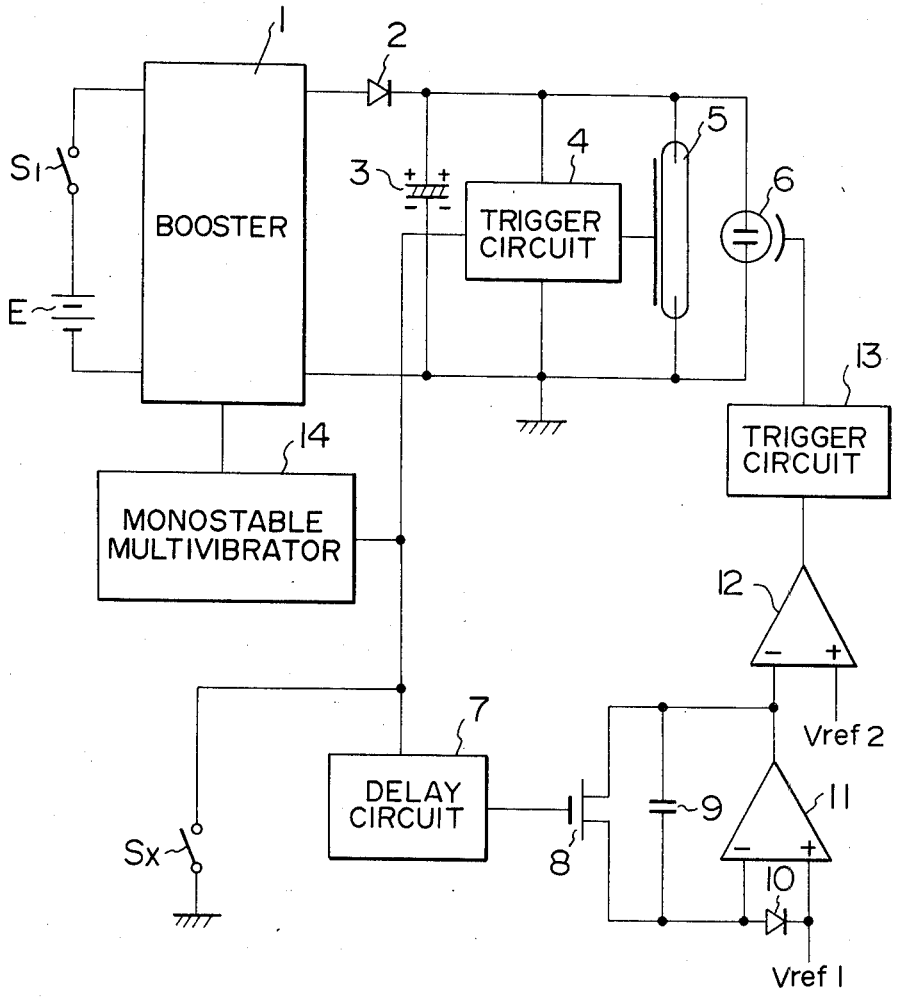
1
2
S1
BOOSTER
3
4
TRIGGER CIRCUIT
5
6
E
13
TRIGGER CIRCUIT
14
MONOSTABLE MULTIVIBRATOR
12
Vref 2
7
DELAY CIRCUIT
9
11
Sx
8
10
Vref 1

AUTOMATIC ELECTRONIC FLASH LIGHT DEVICE

BACKGROUND OF THE INVENTION

1. Field of the Invention

This invention relates to an automatic electronic flash light device for a camera, and more particularly to an improvement of an automatic electronic flash light device in which the electric discharge of the flash light device is terminated when the integrated value of the amount of light reflected by an object to be photographed and illuminated by the flash light has reached a predetermined level.

2. Description of the Prior Art

In the conventional automatic electronic flash light device, an integrating circuit therein which integrates the amount of light reflected by the object to be photographed and illuminated by the flash light is started to operate by a trigger signal for triggering the flash tube. Thus, the conventional automatic electronic flash light device is disadvantageous in that the exposure control cannot be conducted with high accuracy since the integrated value is influenced by noise caused by the trigger of the flash light tube and by the drift of the integrating circuit.

SUMMARY OF THE INVENTION

The primary object of the present invention is to provide an improved automatic electronic flash light device in which an integrated value free of noise caused by trigger of the flash light tube and free of drift of the integrating circuit can be obtained.

Another object of the present invention is to provide an inexpensive automatic electronic flash light device.

In the automatic electronic flash light device of the present invention, the integrating circuit is started to operate by a delayed signal applied thereto after the trigger of the flash light tube.

Thus, the integration of the amount indicative of the scene brightness can be conducted without a noise caused by the trigger of the electronic flash light tube. Accordingly, an accurate exposure control can be conducted.

BRIEF DESCRIPTION OF A DRAWING

The single FIGURE is a circuit diagram of an automatic electronic flash light device in accordance with an embodiment of the present invention.

DESCRIPTION OF THE PREFERRED EMBODIMENT

The single FIGURE shows a circuit diagram of an automatic electronic flash light device in accordance with an embodiment of the present invention. In the FIGURE, a power voltage given by a power source E is applied to a booster 1 through a main switch S1 and the voltage is raised thereby. The raised voltage outputed from the booster 1 is applied to a main capacitor 3 through a diode 2 to charge the same. In parallel to the main capacitor 3, a trigger circuit 4, a flash light tube 5 and a quenching tube 6 are connected.

The input terminal of the trigger circuit 4 is grounded through an X contact switch Sx of a camera, while the trigger output thereof is connected to the trigger electrode disposed adjacent to the side face of the flash light tube 5. The trigger terminal of the quenching tube 6 is connected to the output of a trigger circuit 13.

The input of the trigger circuit 13 is connected with an operational amplifier 12 serving as a comparator. To the positive input of the operational amplifier 12 is connected a reference voltage Vref 2. To the negative input of the operational amplifier 12 is connected the output of an operational amplifier 11 serving as an integrator. Between the positive and negative inputs of the operational amplifier 11 is connected a photoelectric conversion diode 10 which receives light reflected by an object to be photographed. The operational amplifier 11 is provided with a negative feedback circuit including a capacitor 9.

In parallel to the capacitor 9 is connected a MOS FET 8 as a switching element, the gate of which is connected with the output of a delay circuit 7.

The input of the delay circuit 7 is connected with said X contact switch Sx so that the MOS FET 8 is turned off when a predetermined time has lapsed since the closure of the X contact switch Sx.

Further connected to the X contact switch Sx is the trigger input terminal of a monostable multivibrator 14 the output of which is connected to the booster 1 so that when the X contact switch Sx is closed the booster 1 is nullified for a predetermined length of time (2 to 5 microseconds) determined by the monostable multivibrator 14.

The booster 1 may be nullified by, for example, short-circuiting a part of the circuit thereof. The nullification of the booster 1 is well known in the art, and accordingly it will not be described in detail here.

With the above arrangement, when the main capacitor is completely charged and the X contact switch Sx is closed, the flash light tube 5 is started to discharge and at the same time the monostable multivibrator 14 is triggered to nullify the booster 1.

Delayed for 5–20 microseconds from the closure of the X contact switch Sx by means of the delay circuit 7, the MOS FET 8 is turned off. When the MOS FET 8 is turned off, the photo current generated by the diode 10 receiving the light reflected by the object to be photographed starts to charge the capacitor 9. When the charged voltage or the integrated voltage of the capacitor 9 has reached a predetermined level, i.e. Vref 2, the operational amplifier 12 is actuated to turn on the quenching tube 6 through the trigger circuit 13 thereby quenching the electric discharge of the flash tube 5.

Thereafter, the monostable multivibrator 14 is inverted and the booster 1 is again permitted to charge the main capacitor 3 through the diode 2.

Thus, in the automatic electronic flash light device of the present invention, the operation of the integrator 11 is delayed from the trigger of the flash light tube 5. Therefore, the integrated amount of the reflected light is free of the noise caused by the trigger of the flash tube as well as the noise generated from the booster 1. Further, the integrated amount of the reflected light is free of drift of the integrating circuit. It should be noted that the delay time of 5 to 20 microseconds is sufficiently short for the integrated amount of the reflected light not to be influenced thereby.

I claim:

1. An automatic electronic flash light device having a flash light tube, and means for triggering said tube, and in which an electric discharge of the flash light tube is terminated when the integrated amount of the light reflected by an object to be photographed and illuminated by the flash light from the flash light tube has reached a predetermined value comprising: an integrated circuit which integrates the amount of light reflected by the object, and a delay circuit, said integrating circuit being started by a signal applied thereto by said delay circuit, said signal being delayed so as to be generated after said triggering means have triggered said flash light tube.

2. An automatic electronic flash light device as defined in claim 1 wherein the discharge voltage of the flash light tube is passed through a booster and the booster is nullified by a signal for triggering the flash light tube for a predetermined length of period.

3. An automatic electronic flash light device as defined in claim 1 wherein the time of delay of said signal applied to the integrating circuit is within the range of 5 to 20 microseconds.

* * * * *